US010354829B2

(12) United States Patent
Handa et al.

(10) Patent No.: US 10,354,829 B2
(45) Date of Patent: Jul. 16, 2019

(54) MAGNETRON

(71) Applicant: Panasonic Intellectual Property Management Co., Ltd., Osaka (JP)

(72) Inventors: Takanori Handa, Shiga (JP); Nagisa Kuwahara, Shiga (JP); Kohei Kawata, Shiga (JP); Takeshi Ishii, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/062,779

(22) PCT Filed: Feb. 17, 2017

(86) PCT No.: PCT/JP2017/005873
§ 371 (c)(1),
(2) Date: Jun. 15, 2018

(87) PCT Pub. No.: WO2017/154518
PCT Pub. Date: Sep. 14, 2017

(65) Prior Publication Data

US 2019/0157034 A1 May 23, 2019

(30) Foreign Application Priority Data

Mar. 10, 2016 (JP) ..... 2016-046651

(51) Int. Cl.
*H05B 33/00* (2006.01)
*H01J 23/44* (2006.01)
(Continued)

(52) U.S. Cl.
CPC ..... *H01J 23/44* (2013.01); *H01J 25/50* (2013.01); *H05B 6/681* (2013.01)

(58) Field of Classification Search
CPC ..... H01L 2924/00; H01L 21/2855; H01L 21/76805; H01L 21/76814;
(Continued)

(56) References Cited

U.S. PATENT DOCUMENTS

2004/0095073 A1* 5/2004 Lee ..... H01J 9/26 315/39.51
2014/0191656 A1 7/2014 Ishii

FOREIGN PATENT DOCUMENTS

JP 51-117559 U 9/1976
JP 8-185806 7/1996
(Continued)

OTHER PUBLICATIONS

International Search Report of PCT application No. PCT/JP2017/005873 dated May 9, 2017.

*Primary Examiner* — Monica C King
(74) *Attorney, Agent, or Firm* — Wenderoth, Lind & Ponack, L.L.P.

(57) ABSTRACT

An antenna part of a magnetron includes an exhaust portion that is connected to an antenna conductor derived from an anode part and has an output terminal from which a microwave is outputted, and an output-side ceramic stem that holds internally the antenna conductor and is firmly fixed to the exhaust portion to insulate electrically a side pipe connected to the anode part of a main body of the magnetron from the exhaust portion. An antenna part further includes an antenna cap that is joined to the exhaust portion by a conductive adhesive arranged on an outer periphery of the exhaust portion. Accordingly, it is possible to provide the magnetron that can prevent occurrence of electric discharge between the antenna cap and the exhaust portion.

9 Claims, 7 Drawing Sheets

(51) Int. Cl.
*H01J 25/50* (2006.01)
*H05B 6/68* (2006.01)

(58) Field of Classification Search
CPC ..... H01L 21/76843; H01L 21/76844; H01L 21/76846; H01L 21/76862; H01L 21/76865; H01L 21/76868; H01L 21/76871; H01L 21/76873; H01L 21/76876; H01L 21/76877; H01L 2221/1089; H01L 2224/48091; H01L 2924/01015; H01L 2924/01047; H01L 2924/1305; H01L 2924/13091; H01L 2924/1461; H01L 2924/181; H01L 2924/30107; H01L 2924/3011; H01L 2924/3025; H01L 2924/00012; H01L 2924/00014; H01L 21/28562; H01L 2224/48247; H01L 23/53285; H01L 2924/10253; H01L 2924/10329; H01L 39/126; H01L 39/128; H01L 39/143; H01L 39/225; H01F 1/0063; H01F 10/007; H01F 1/445; H01F 6/06; H05B 6/642; H05B 6/6482; H05B 6/806
See application file for complete search history.

(56) References Cited

FOREIGN PATENT DOCUMENTS

| | | |
|---|---|---|
| JP | 8-306322 | 11/1996 |
| JP | 2008-010352 A | 1/2008 |
| JP | 2014-135161 | 7/2014 |

* cited by examiner

MAGNETRON

This application is a U.S. national stage application of the PCT International Application No. PCT/JP2017/005873 filed on Feb. 17, 2017, which claims the benefit of foreign priority of Japanese patent application No. 2016-046651 filed on Mar. 10, 2016, the contents all of which are incorporated herein by reference.

TECHNICAL FIELD

The present invention relates to a magnetron as a microwave generator used in a microwave heater or the like.

BACKGROUND ART

A microwave heater includes a magnetron that constitutes a microwave generator. The magnetron has a main body including an antenna part, an anode part, and a cathode part.

A general configuration of a conventional magnetron will be described below with reference to FIGS. 9 and 10.

FIG. 9 is a vertical cross-section view of a configuration of a main body of the conventional magnetron. FIG. 10 is a vertical cross-section view of antenna part 101 in the conventional magnetron.

As illustrated in FIGS. 9 and 10, the magnetron includes antenna part 101, anode part 102, cathode part 103, and the like. Antenna part 101 holds internally antenna conductor 104 guiding a microwave. Anode part 102 holds internally a plurality of vanes 105 radially arranged. Cathode part 103 holds internally cathode lead wire 107.

Vanes 105 in anode part 102 are connected to antenna conductor 104 derived to antenna part 101. Filaments 106 as cathodes are arranged in the center of vanes 105 in anode part 102. Filaments 106 are connected to cathode lead wire 107. Cathode lead wire 107 is connected to input terminal 109 via terminal-side ceramic stem 108.

Antenna part 101 of the magnetron has antenna conductor 104 derived from anode part 102 and connected to exhaust pipe 112 via output-side ceramic stem 111. Exhaust pipe 112 has chip-off portion 113. With chip-off portion 113, the main body of the magnetron in which anode part 102, cathode part 103, and antenna conductor 104 are surrounded by vacuum walls can be maintained under vacuum.

Chip-off portion 113 has a sharpened portion. Accordingly, antenna cap 110 is press-fitted to protect chip-off portion 113 of exhaust pipe 112. Antenna cap 110 is arranged in a wave guide to serve as part of an output terminal. Accordingly, antenna cap 110 radiates a microwave generated in the main body of the magnetron to the wave guide.

The general magnetron is configured as described above.

In the thus configured magnetron, antenna cap 110 may fall off exhaust pipe 112 as described below.

Specifically, the magnetron is repeatedly used for a long period of time with large temperature differences between an operating time for generating a microwave and a non-operating time. This weakens a degree of pressure bonding between press-fitting portions of antenna cap 110 and exhaust pipe 112. Accordingly, antenna cap 110 may fall off exhaust pipe 112.

When antenna cap 110 falls off exhaust pipe 112, electric discharge occurs between exposed exhaust pipe 112 and fallen antenna cap 110 or the wave guide. Accordingly, the magnetron becomes unstable in operation. Further, in some cases, exhaust pipe 112 may have a vacuum leak, for example.

Thus, to prevent antenna cap 110 from falling off exhaust pipe 112, there have been conventionally proposed magnetrons of various configurations (for example, refer to PTL 1, 2, and 3).

The magnetron described in PTL 1 has a projection on the inner peripheral surface of an antenna cap and a concave groove formed in the outer peripheral surface of an exhaust pipe onto which the antenna cap is press-fitted. The projection in the antenna and the concave groove in the exhaust pipe are fitted together to prevent the falling of the antenna cap.

In the magnetron described in PTL 2, an antenna cap is formed of a composite plate in which a foundation of an iron-based material is coated with a surface skin film of an alloy of silver and copper and an anti-oxidation film made of the same material as that for the surface skin film. Then, the composite plate is subjected to a drawing process to form the antenna cap. Accordingly, the antenna cap is enhanced in mechanical strength to prevent the falling off the exhaust pipe.

In the magnetron described in PTL 3, a hole is formed in the side surface of the antenna cap, the antenna cap is press-fitted onto the exhaust pipe, and the hole in the antenna cap and the exhaust pipe are spot-welded. This configuration prevents the falling of the antenna cap.

As described above, the conventional magnetrons are configured such that the antenna cap and the exhaust pipe are basically press-fitted and firmly fixed to prevent the antenna cap from falling off the exhaust pipe.

However, an experiment result described below has revealed that the configuration of the magnetron described in PTL 1 cannot prevent the occurrence of electric discharge in a gap between the antenna cap and the exhaust pipe.

Specifically, the inventors of the prevent application have experimentally observed electric discharge between the antenna cap and the exhaust pipe in the magnetron configured as described above. In particular, the inventors have found that, when there is a gap between the edge of the press-fitting portion in the antenna cap and the portion of the exhaust pipe joined to the output-side ceramic stem, electric charge would occur between the edge and the joined portion. Specifically, the inventors of the present application have found that electric discharge would occur when the gap between the edge and the joined portion has a spatial distance of 0.2 mm as a design dimension. The inventors of the present application attribute the electric discharge to the slightly widened and flared edge of the press-fit portion in the antenna cap. That is, a potential difference is generated by a creepage distance between the edge of the press-fit portion and the joined portion of the exhaust pipe and the output-side ceramic stem. This potential difference is considered to cause the electric discharge.

In a general magnetron, both the antenna cap and the exhaust pipe firmly fixed to each other by press-fitting are formed in the shape of a cylinder. In this case, it is not possible in the terms of mechanical processing to form the two cylinders in a true circle and bring them into absolute contact with each other along the entire circumference. Specifically, the conventional antenna cap is formed by subjecting a thin-plate metallic material of stainless, brass, aluminum, or the like to a drawing process. Accordingly, the press-fit portion of the antenna cap is formed in an almost triangular or almost square open shape with corners to be in point-contact with the cylindrical exhaust pipe at at least three points. This creates a gap between the edge and the joined portion to cause electric discharge.

In addition, the magnetrons described in PTL 2 and PTL 3 are configured such that the antenna cap is press-fitted and firmly fixed to the exhaust pipe as in the foregoing case. Accordingly, the edge of the antenna cap is formed in a slightly flared shape. The press-fit portion is press-fitted by partial contact without close adhesion along the entire circumference. This creates some gap between the antenna cap and the exhaust pipe. As a result, electric discharge may occur in the formed gap.

A microwave heater used in a household microwave oven or the like generally uses a microwave of 2.45 GHz. In addition, an industrial microwave heater uses a high-frequency microwave of 5.0 GHz or more, for example, 5.8 GHz. That is, the magnetron generating a higher-frequency microwave has a shorter wavelength. Accordingly, when the antenna cap is press-fitted into the exhaust pipe, electric discharge is more likely to occur even in a slight gap. Therefore, there is demand for a magnetron that can suppress electric discharge in a more reliable manner.

CITATION LIST

Patent Literatures

PTL 1: Unexamined Japanese Patent Publication No. 8-185806

PTL 2: Unexamined Japanese Patent Publication No. 8-306322

PTL 3: Unexamined Japanese Patent Publication No. 2014-135161

SUMMARY OF THE INVENTION

A magnetron in the present invention includes a main body and an antenna part, the main body having an anode part and a cathode part and the antenna part being connected to the main body and outputs a microwave. The antenna part includes the exhaust portion that is connected to the antenna conductor derived from the anode part and has the output terminal from which the microwave is outputted, the output-side ceramic stem that holds internally the antenna conductor and is firmly fixed to the exhaust portion to insulate electrically the side pipe connected to the anode part of the main body of the magnetron from the exhaust portion, and the antenna cap that is joined to the exhaust portion by the conductive adhesive arranged on the outer periphery of the exhaust portion.

According to this configuration, it is possible to prevent the antenna cap from falling off the exhaust pipe. In addition, it is possible to, while the antenna cap is attached to the exhaust pipe, prevent the occurrence of electric discharge between the antenna cap and the exhaust pipe in a more reliable manner. Accordingly, the highly reliable magnetron is provided.

DESCRIPTION OF EMBODIMENTS

A magnetron as a microwave generator used in a microwave heater according to an exemplary embodiment of the present invention will be described below with reference to the attached drawings. The magnetron according to the present invention is not limited to the configuration of the magnetron described below in relation to the exemplary embodiment but also includes configurations of the magnetron equivalent to the technical idea in the exemplary embodiment described below. The exemplary embodiment described below is an example of the present invention. That is, the configurations, functions, and operations of the present exemplary embodiment are mere examples and do not limit the present invention. Among the constituents in the exemplary embodiments described below, constituents which are not described in the independent claims showing the top level concept are described as arbitrary constituents.

Exemplary Embodiment

A configuration of the magnetron according to the exemplary embodiment of the present invention will be described below with reference to FIG. 1.

Figure 1:
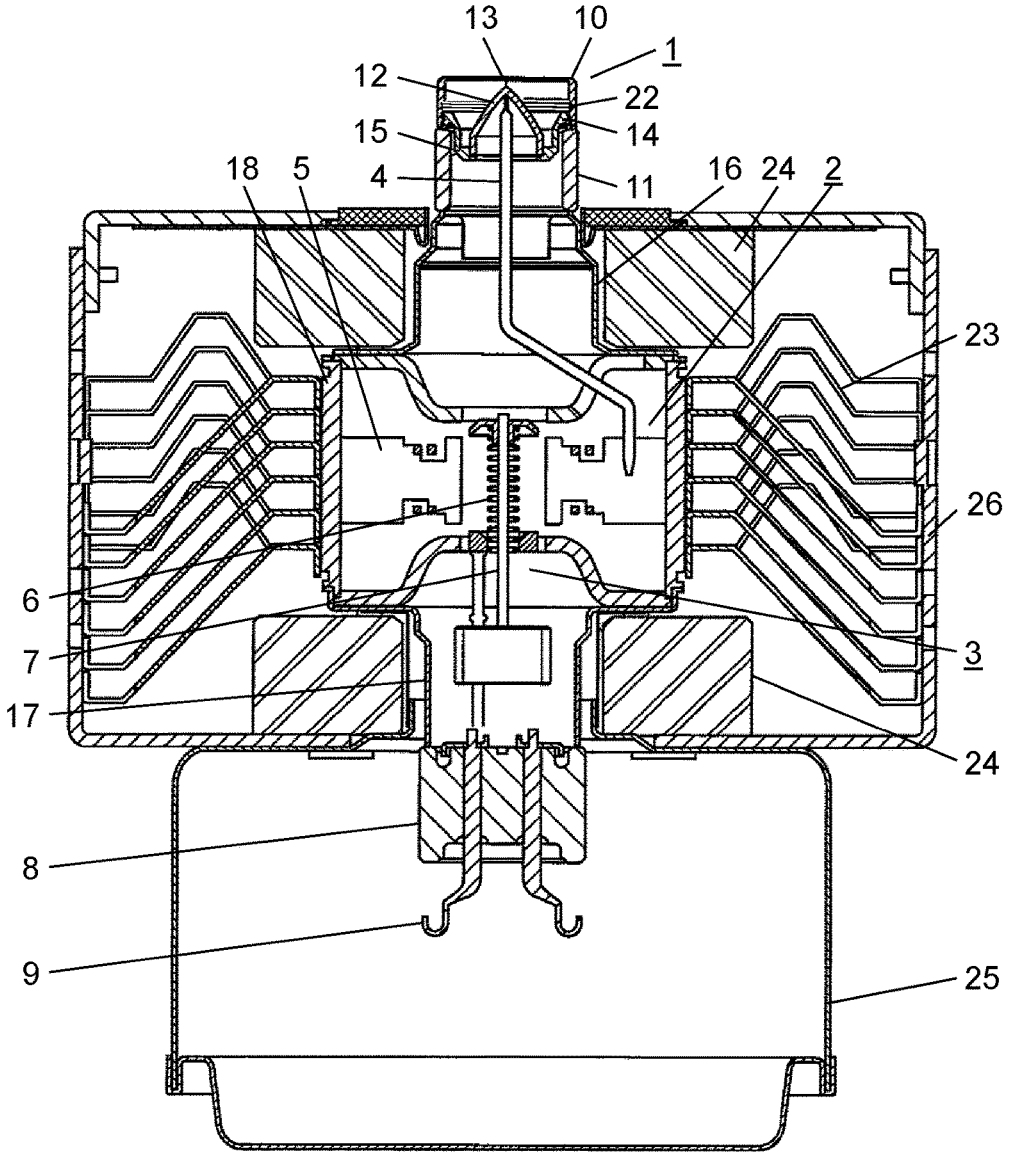
FIG. 1 is a cross-section view of a configuration of a magnetron according to an exemplary embodiment of the present invention.

FIG. 1 is a vertical cross-section view of a configuration of the magnetron according to the exemplary embodiment of the present invention.

The magnetron according to the present exemplary embodiment includes a main body of the magnetron constituting a main body portion, frame-shaped yoke 26 including an anode-side yoke and a cathode-side yoke, shield case 25, and others, as illustrated in FIG. 1.

The following description is based on the assumption that the main body of the magnetron includes antenna part 1, anode part 2, and cathode part 3 including input terminal 9. The main body of the magnetron constitutes an output portion that generates and radiates a microwave. As the magnetron according to the present exemplary embodiment, a magnetron generating a microwave of as high frequency as 5.8 GHz is taken as an example.

Frame-shaped yoke 26 stores part of the main body of the magnetron, cooling fin 23, magnets 24, and others. Cooling fin 23 is arranged around anode part 2 in the center of the main body of the magnetron to serve as a radiator that radiates heat generated by anode part 2. Magnets 24 are disposed between anode cylinder 18 and frame-shaped yoke 26 on an input side (the lower side in FIG. 1) and an output side (the upper side in FIG. 1) of anode part 2 to constitute a magnetic field generation source.

Antenna part 1 of the main body of the magnetron includes antenna cap 10 and exhaust portion 15. Antenna part 1 holds internally antenna conductor 4 to guide a microwave excited by anode part 2 and cathode part 3 to exhaust portion 15. Anode part 2 holds internally a plurality of vanes 5 radially arranged. Cathode part 3 includes filaments 6 constituting cathodes in the center of vanes 5 of anode part 2. Antenna conductor 4 is connected to vanes 5 of anode part 2 and derived to exhaust portion 15 of antenna part 1. Filaments 6 are connected to cathode lead wire 7. Cathode lead wire 7 penetrates through terminal-side ceramic stem 8 and connects to input terminal 9. Cathode lead wire 7 penetrating through terminal-side ceramic stem 8 and input terminal 9 are covered with and stored in shield case 25.

The main body of the magnetron has side pipe 16 and side pipe 17 as metallic cylinders, on output side and terminal side of anode cylinder 18 constituting outer appearance of anode part 2. Output-side ceramic stem 11 is arranged on side pipe 16 on the output side, and terminal-side ceramic stem 8 is arranged on side pipe 17 on the terminal side. Antenna part 1 is arranged on output-side ceramic stem 11.

The main body of the magnetron has a vacuum wall formed by anode cylinder 18, side pipe 16, side pipe 17, terminal-side ceramic stem 8, output-side ceramic stem 11, and exhaust portion 15 of antenna part 1 firmly fixed to output-side ceramic stem 11.

The magnetron according to the present exemplary embodiment is configured as described above.

A configuration of antenna part 1 of the magnetron according to the present exemplary embodiment will be described below with reference to FIG. 2.

Figure 2:
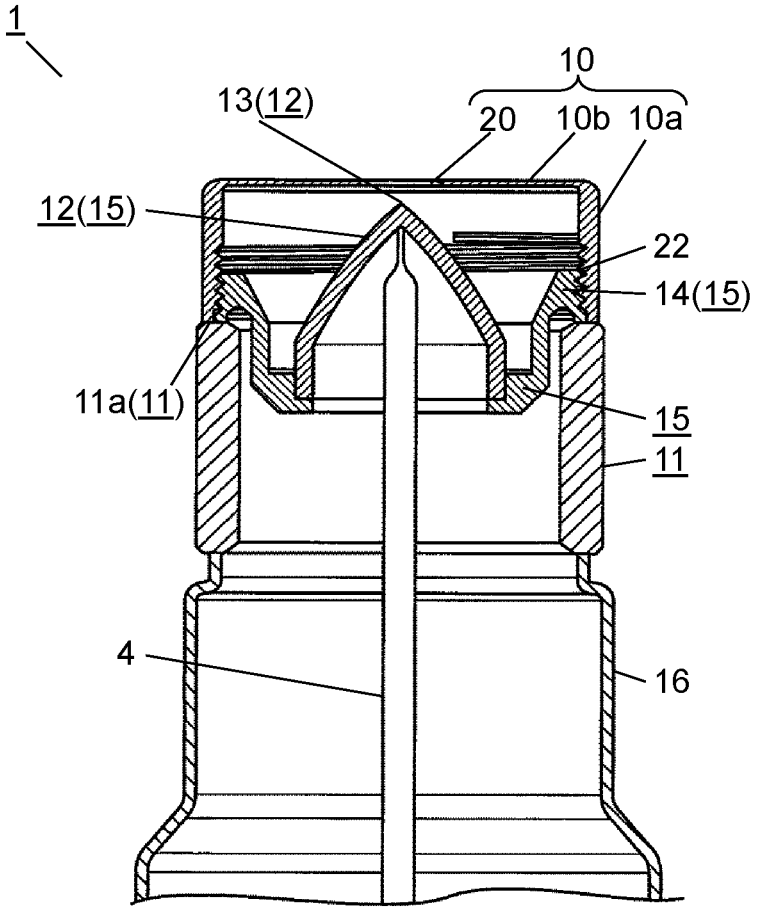
FIG. 2 is a vertical cross-section view of a configuration of an antenna part in the magnetron according to the exemplary embodiment.

FIG. 2 is a vertical cross-section view of antenna part 1 and its vicinity in the magnetron according to the exemplary embodiment.

Exhaust portion 15 of antenna part 1 is connected to antenna conductor 4 derived from anode part 2 via output-side ceramic stem 11 (hereinafter, also called "insulating ring 11") as illustrated in FIG. 2. Insulating ring 11 holds internally antenna conductor 4 and is firmly fixed to exhaust portion 15. Insulating ring 11 insulates electrically side pipe 16 connected to anode part 2 and cathode part 3 from exhaust portion 15 of the main body of the magnetron.

Exhaust portion 15 includes exhaust pipe 12, exhaust pipe holding portion 14 (hereinafter, also called "bushing 14"), and others. Exhaust pipe 12 is fixed to insulating ring 11 via exhaust pipe holding portion 14.

Exhaust pipe 12 has chip-off portion 13 for vacuum-holding the main body of the magnetron that surrounds anode part 2, cathode part 3, and antenna conductor 4 by the vacuum wall.

Bushing 14 is screwed into antenna cap 10 described later. Antenna cap 10 is provided to protect chip-off portion 13 of exhaust pipe 12 and stabilize the output of a microwave. In general, chip-off portion 13 is likely to cause electric discharge between chip-off portion 13 and the wave guide due to its dimensional variation and sharp tip. Accordingly, chip-off portion 13 is covered with antenna cap 10 to suppress unnecessary phenomenon and stabilize the output of a microwave. Antenna cap 10 is disposed to protrude into the wave guide. That is, antenna cap 10 constitutes an output terminal that radiates a microwave into the wave guide.

Antenna part 1 of the magnetron is configured as described above.

Figure 3:
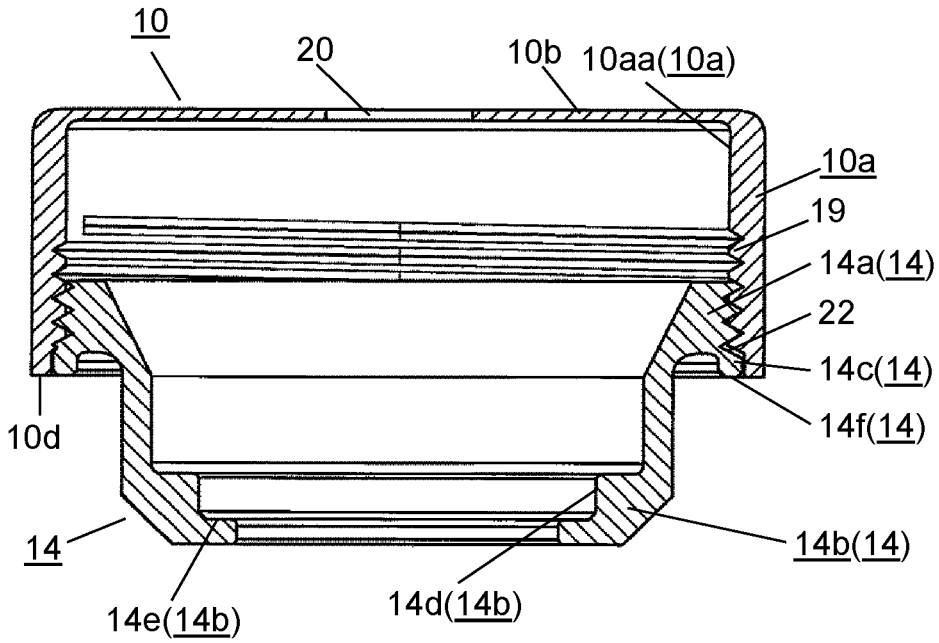
FIG. 3 is a cross-section view of an antenna cap that is screwed onto a bushing in the magnetron according to the exemplary embodiment.
Figure 4:
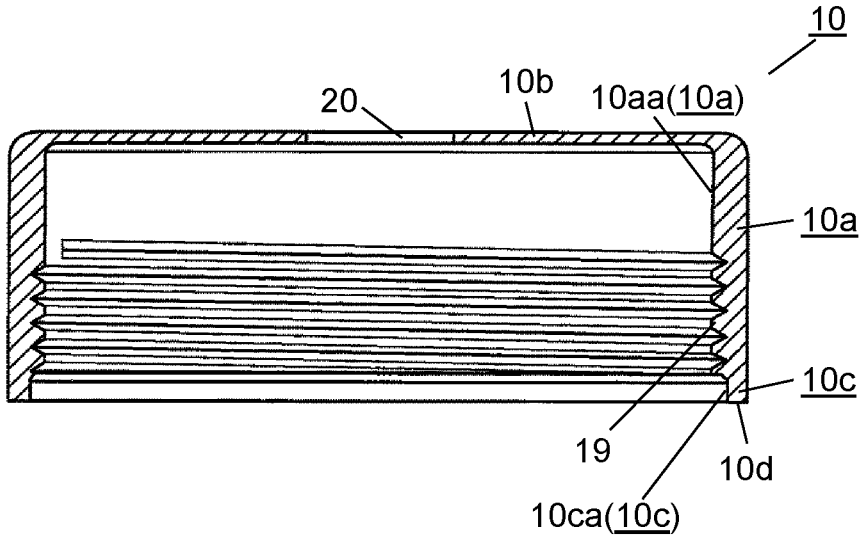
FIG. 4 is a vertical cross-section view of the antenna cap according to the exemplary embodiment.
Figure 5:
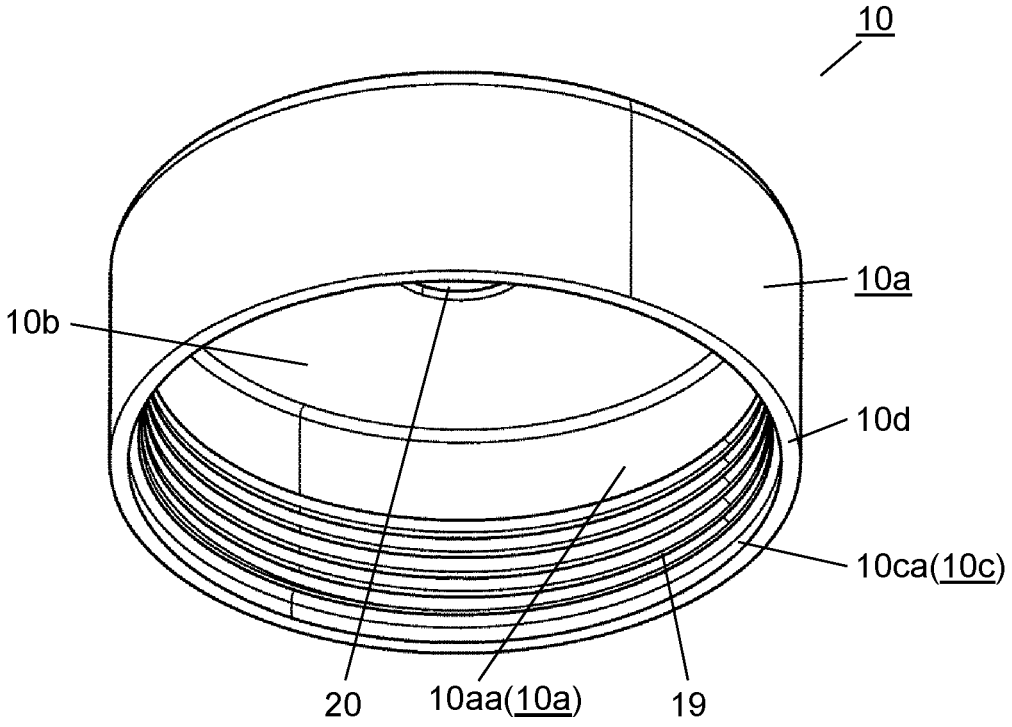
FIG. 5 is a perspective view of the antenna cap according to the exemplary embodiment.
Figure 6:
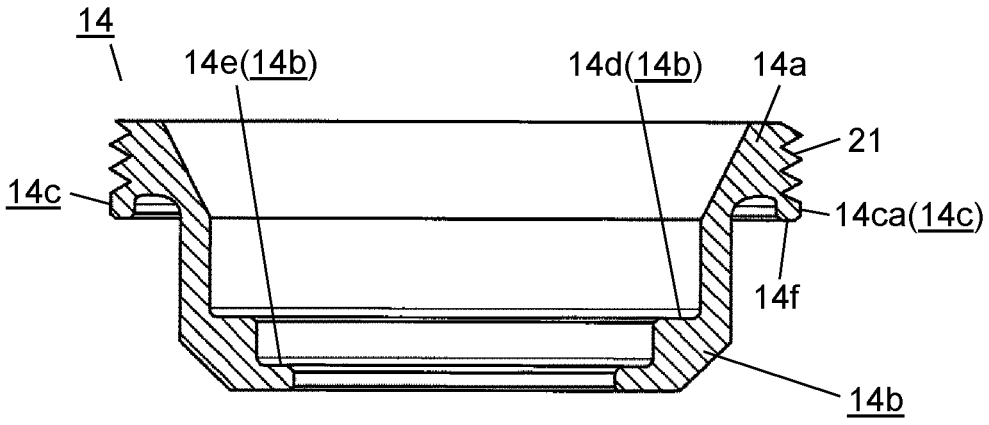
FIG. 6 is a vertical cross-section view of the bushing according to the exemplary embodiment.
Figure 7:
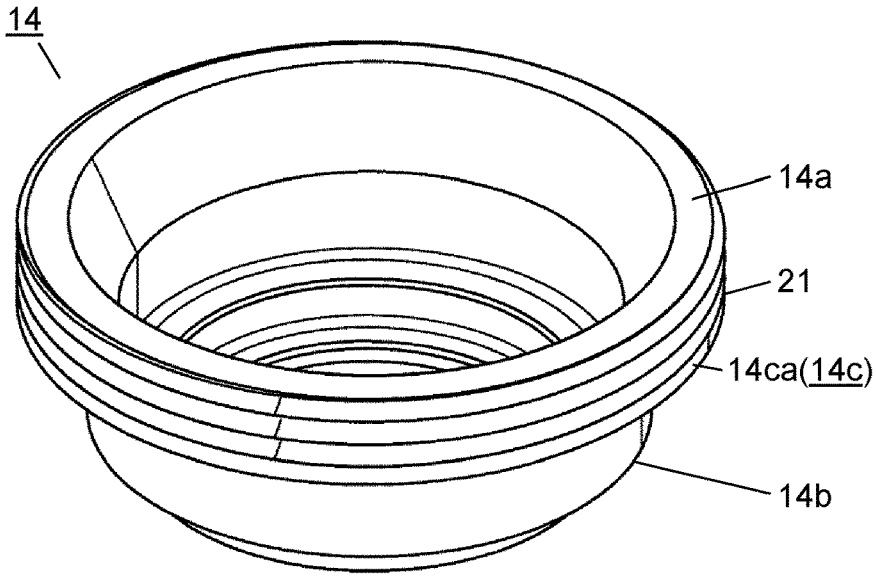
FIG. 7 is a perspective view of the bushing according to the exemplary embodiment.

A configuration of antenna cap 10 and exhaust portion 15 of antenna part 1 will be described below more specifically with reference to FIGS. 3 to 7. FIG. 3 is a cross-section view of antenna cap 10 that is screwed onto bushing 14. FIG. 4 is a vertical cross-section view of antenna cap 10. FIG. 5 is a perspective view of antenna cap 10 as seen from an obliquely lower direction. FIG. 6 is a vertical cross-section view of bushing 14. FIG. 7 is a perspective view of bushing 14 as seen from an obliquely upper direction.

First, as illustrated in FIGS. 3 to 5, antenna cap 10 is formed in a lid shape and includes cylindrical side surface part 10*a* and ceiling 10*b* with through hole 20. Side surface part 10*a* of antenna cap 10 has threaded portion 19 (for example, a female screw thread) on inner peripheral surface 10*aa*. That is, antenna cap 10 has an open surface opposed to ceiling 10*b* and threaded portion 19 to which bushing 14 is attached (screwed) on inner peripheral surface 10*aa* of side surface part 10*a*.

Antenna cap 10 is a non-magnetic body formed of a metallic material with low resistivity (high conductivity) such as copper, for example. Accordingly, antenna cap 10 can be integrally formed by cutting the metallic material.

Side surface part 10*a* of antenna cap 10 is made thicker than ceiling 10*b* to form threaded portion 19 on inner peripheral surface 10*aa*. In this case, threaded portion 19 is not formed up to edge 10*c* of side surface part 10*a* in the vicinity of the open end of antenna cap 10. That is, antenna cap 10 has edge inner peripheral surface 10*ca* formed in the vicinity of edge 10*c* in parallel to a movement direction of antenna cap 10 screwed onto bushing 14. Accordingly, when antenna cap 10 is screwed onto bushing 14, edge inner peripheral surface 10*ca* of edge 10*c* of antenna cap 10 and edge outer peripheral surface 14*ca* (see FIG. 6) of edge 14*c* of opposed bushing 14 are arranged with a fine gap of 0.1 mm or less, for example, between the two surfaces.

Ceiling 10*b* of antenna cap 10 has through hole 20 as described above. Through hole 20 constitutes a vent hole that discharges internal air when antenna cap 10 is attached (screwed) to bushing 14. Corner portions connecting side surface part 10*a* and ceiling 10*b* of antenna cap 10 are formed in a curved shape. This effectively suppresses electric discharge that is likely to occur with sharp corner portions.

Meanwhile, bushing 14 screwed into antenna cap 10 has outer peripheral side surface part 14*a* and inner peripheral bottom portion 14*b* with step 14*d* and inner peripheral end surface 14*e* as illustrated in FIG. 6. Outer peripheral side surface part 14*a* has threaded portion 21 (for example, a male screw thread). Inner peripheral bottom portion 14*b* projects from outer peripheral side surface part 14*a* to the inner peripheral side. Exhaust pipe 12 of exhaust portion 15 is joined to inner peripheral end surface 14*e* by brazing, for example, as illustrated in FIG. 2.

As with threaded portion 19 of antenna cap 10, threaded portion 21 of bushing 14 is not formed up to edge 14*c* of outer peripheral side surface part 14*a* in the vicinity of the lower end of bushing 14. That is, edge 14*c* has edge outer peripheral surface 14*ca* in parallel to the inner peripheral surface of edge 10*c* of screwed antenna cap 10. Accordingly, bushing 14 and antenna cap 10 are screwed together with a predetermined or smaller gap (0.1 mm or less) between edge outer peripheral surface 14*ca* of edge 14*c* of bushing 14 and edge inner peripheral surface 10*ca* of edge 10*c* of antenna cap 10.

That is, when threaded portion 19 of antenna cap 10 is screwed onto threaded portion 21 of bushing 14, antenna cap 10 and bushing 14 are opposed to and screwed to each other with a predetermined or smaller gap between edge 10*c* of antenna cap 10 and edge 14*c* of bushing 14. At the same time, lower end surface 10*d* (downward surface in FIG. 4) of edge 10*c* of antenna cap 10 is arranged and opposed to upper end surface 11*a* of insulating ring 11 (see FIG. 2). In this case, there is a predetermined or smaller gap (0.1 mm or less) between lower end surface 10*d* of edge 10*c* of antenna cap 10 and upper end surface 11*a* of insulating ring 11.

Lower end surface 14*f* of edge 14*c* of bushing 14 (downward surface of edge 14*c* in FIG. 6) is formed as a flat joint surface that is capable of brazing to upper end surface 11*a* of insulating ring 11, for example. In this case, lower end surface 14*f* of edge 14*c* of bushing 14 and upper end surface 11*a* of insulating ring 11 are preferably joined together by a minimal joint surface area. This is to prevent the occurrence of large distortion on the joint surface allowing for differences in properties between bushing 14 formed of a metallic material and insulating ring 11 formed of ceramic, such as thermal expansion rate, for example.

Inner peripheral bottom portion 14*b* of bushing 14 has step 14*d* formed to protrude inward and inner peripheral end surface 14*e* as described above. Inner peripheral end surface 14*e* is provided on the lowest end side of step 14*d* and is joined to exhaust pipe 12 of exhaust portion 15 by brazing with silver solder, for example. In this case, bushing 14 and exhaust pipe 12 are both formed of a metallic material. Accordingly, there is hardly need to allow for the properties such as thermal expansion and contraction in joining bushing 14 and exhaust pipe 12. That is, even when the area of the joint surface between bushing 14 and exhaust pipe 12 increases, there hardly occurs a problem such as distortion due to an expansion difference or the like. Accordingly, the joint work can be facilitated by increasing the area of the joint surface between bushing 14 and exhaust pipe 12.

In the present exemplary embodiment, antenna cap 10 is screwed onto bushing 14 by conductive adhesive 22 applied to threaded portion 21 of outer peripheral side surface part 14*a* of bushing 14. Accordingly, antenna cap 10 and bushing 14 are joined together. In this case, a thermoset adhesive is used as conductive adhesive 22 to join antenna cap 10 and bushing 14. Accordingly, there is no gap between the screwed surfaces of respective threaded portions 19 and 21 of antenna cap 10 and bushing 14 due to charging of conductive adhesive 22. In addition, charging conductive adhesive 22 into the entire screwed surfaces allows antenna cap 10 and bushing 14 to be electrically connected in a more reliable manner.

In the present exemplary embodiment, a high-conductivity, high-strength adhesive such as an epoxy thermoset resin is preferably used as conductive adhesive 22. Specifically, when being hardened at 150° C. for 30 minutes as hardening conditions, for example, conductive adhesive 22 provides an electric resistivity of $6\times10^{-5}$ Ω·cm and an adhesive strength of 12 N/mm$^2$. In the present exemplary embodiment, the adhesive with low electric resistivity has an electric resistivity of $10^{-4}$ Ω·cm, for example.

In the present exemplary embodiment, antenna cap 10 is formed of a non-magnetic body of highly conductive copper as an example but is not limited to this. For example, the high-conductivity metallic material has at least an electric resistivity of $10^{-5}$ Ω·cm or less. In addition, besides copper, antenna cap 10 may be formed of a non-magnetic metallic material such as aluminum, non-magnetic stainless steel, or brass, for example.

In the present exemplary embodiment, a configuration of the magnetron oscillating at an oscillating frequency of 5.8 GHz is taken as an example. In general, in the case of a magnetron that generates a microwave at a high frequency, there is a risk that electric discharge occurs with a slight gap between exhaust portion 15 and antenna cap 10 of antenna part 1. However, in the configuration of the magnetron in the present exemplary embodiment, exhaust portion 15 and antenna cap 10 are firmly fixed to each other with conductive adhesive 22 charged between exhaust portion 15 and antenna cap 10. This eliminates the formation of a slight gap. Accordingly, it is possible to prevent the occurrence of electric discharge between exhaust portion 15 and antenna cap 10 in a more reliable manner.

That is, the magnetron of the present exemplary embodiment is configured such that the antenna cap is joined to the exhaust portion via the conductive adhesive. Accordingly, the adhesive is charged between the antenna cap and the exhaust portion to form no gap between the antenna cap and the exhaust portion. The antenna cap and the exhaust portion are joined together by the conductive adhesive in a more reliable manner. This makes it possible to implement the highly reliable magnetron.

In addition, the magnetron of the present exemplary embodiment has the threaded portion on the inner peripheral surface of the antenna cap. The threaded portion of the exhaust portion opposedly provided is screwed into the threaded portion of the antenna cap, and the threaded portions are fixed together via the conductive adhesive. Accordingly, even when the magnetron is used for a long period of time, the antenna cap is unlikely to fall off the exhaust portion. This makes it possible to prevent the exhaust pipe with the chip-off portion from becoming exposed inside the wave guide due to the falling of the antenna cap.

In the magnetron of the present exemplary embodiment, the antenna cap and the exhaust portion are in electrical contact with each other in a more reliable manner by the conductive adhesive applied to the threaded portions. The antenna cap and the exhaust portion are in line contact with each other in a spiral form at the threaded portions without intermittence in a circumferential direction. Accordingly, the antenna cap and the exhaust portion can be electrically connected together in a more reliable manner.

In the magnetron of the present exemplary embodiment, the antenna cap and the exhaust portion are formed of a non-magnetic, high-conductivity material that is unlikely to absorb a microwave, such as copper, for example. Accordingly, it is possible to suppress the attenuation of a microwave radiated from the antenna cap as an output terminal. This makes it possible to form the magnetron that is capable of outputting a microwave at a high efficiency.

In the magnetron of the present exemplary embodiment, the conductive adhesive is charged and hardened between the threaded portion of the antenna cap and the threaded portion of the exhaust portion to fix the threaded portions firmly to each other. Accordingly, the screwed antenna cap and exhaust portion are unlikely to become loosen even if the magnetron is used for a long period of time. This makes it possible to build the magnetron as a microwave generator that is high in safety and reliability even under long-term use.

In the magnetron of the present exemplary embodiment, the antenna cap is screwed and joined to the exhaust portion via the threaded portions. This makes it possible to set the screwing amount (the screwing length) of the antenna cap into the exhaust portion to an arbitrary desired value.

That is, the antenna cap as the output terminal of a magnetron is inserted and disposed in the interior of the wave guide. In this case, the insertion length of the antenna cap into the wave guide can be adjusted by the screwing amount of the threaded portions. This facilitates the alignment with individual components such as the adjustment of impedance to load. In this case, the thread pitch in the threaded portions of the antenna cap and the exhaust portion may be narrowed or widened, for example. This makes it possible to change arbitrarily the adjustment accuracy for fine adjustment or the like.

The magnetron of the present exemplary embodiment is not limited to the foregoing configuration of the present exemplary embodiment. For example, the magnetron may be configured as described below with reference to FIG. 8 as far as the exhaust portion and the antenna cap can be firmly fixed to each other by charging a conductive adhesive between the exhaust portion and the antenna cap, for example. This makes it possible to eliminate the creation of a slight gap by charging the conductive adhesive between the exhaust portion and the antenna cap. As a result, it is possible to prevent the occurrence of electric discharge between the exhaust portion and the antenna cap in a more reliable manner.

Figure 8:
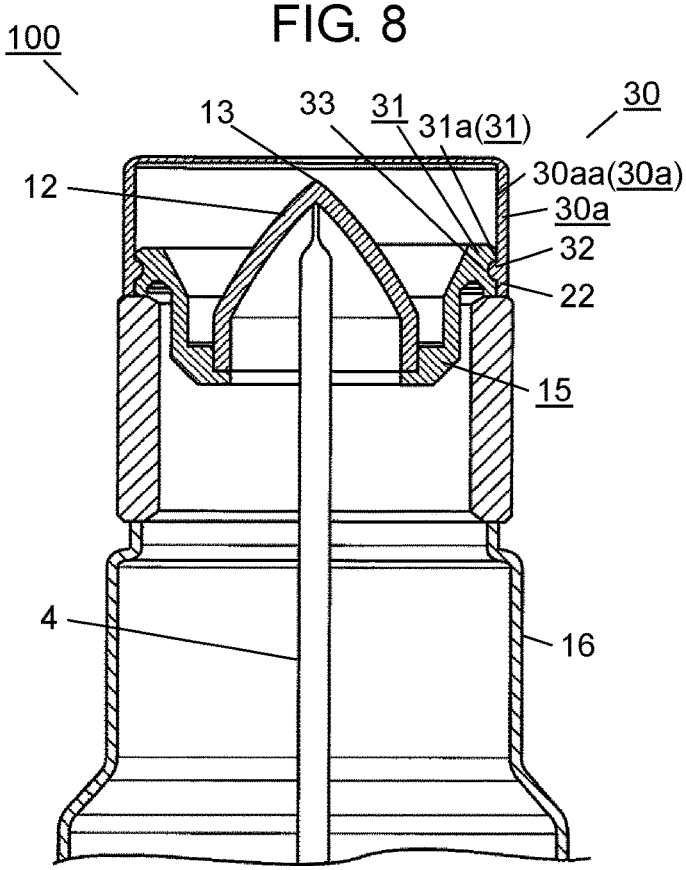
FIG. 8 is a cross-section view of a modification example of the antenna part in the magnetron according to the exemplary embodiment.
Figure 9:
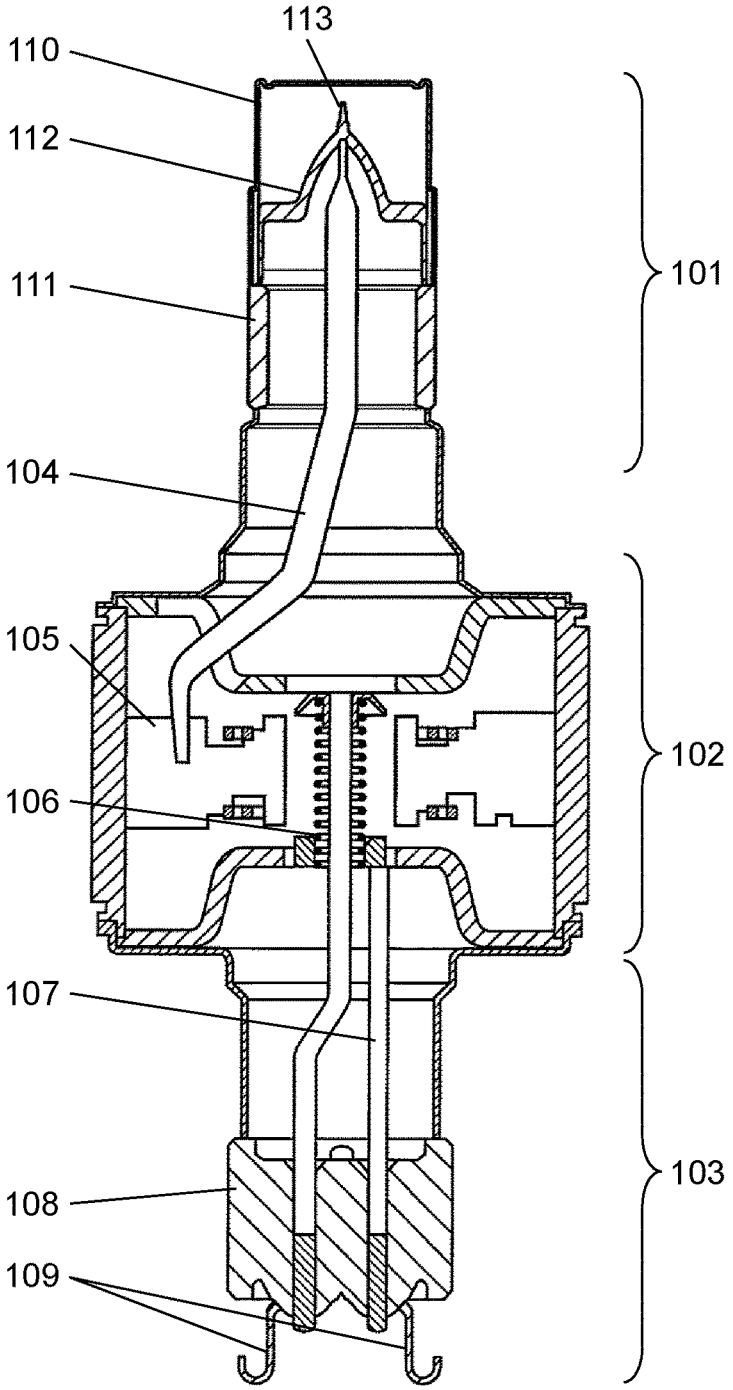
FIG. 9 Prior Art
FIG. 9 is a vertical cross-section view of a configuration of a main body of a conventional magnetron.
Figure 10:
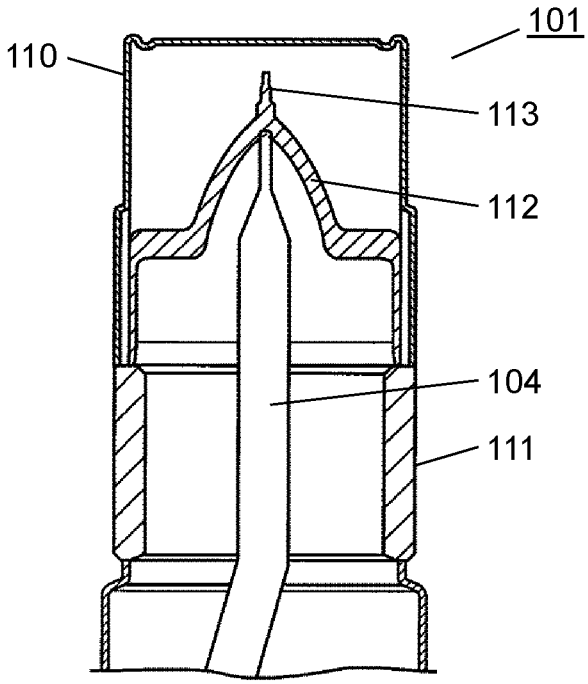
FIG. 10 Prior Art
FIG. 10 is a vertical cross-section view of an antenna part in the conventional magnetron.

FIG. 8 is a vertical cross-section view of a modification example of an antenna part in the magnetron according to the exemplary embodiment. In the cross-section view of FIG. 8, antenna cap 30 is joined to bushing 31.

Antenna part 100 of the magnetron according to the modification example illustrated in FIG. 8 is different from antenna part 1 of the magnetron illustrated in FIGS. 1 to 7 in that inner peripheral surface 30*aa* of cylindrical outer peripheral side surface part 30*a* of antenna cap 30 has convex portion 32 and outer peripheral surface 31*a* of opposed bushing 31 has concave portion 33. Other components of the magnetron are identical to those of the magnetron illustrated in FIGS. 1 to 7, and thus the same reference signs are given to the same components and descriptions of those components will be omitted.

That is, as illustrated in FIG. 8, antenna cap 30 and bushing 31 of antenna part 100 are provided with concave portion 33 and convex portion 32 instead of threaded portions 19 and 21 of the antenna part 1 described above. Convex portion 32 of antenna cap 30 and concave portion 33 of bushing 31 are fitted to each other.

Specifically, conductive adhesive 22 is applied to concave portion 33 of outer peripheral surface 31*a* of bushing 31 as in the foregoing embodiment. After that, convex portion 32 of antenna cap 30 is fitted onto concave portion 33 of bushing 31 with conductive adhesive 22. Accordingly, antenna cap 30 and bushing 31 are joined together. In this case, a thermoset adhesive is used for joining as conductive adhesive 22 as in the foregoing case. Accordingly, conductive adhesive 22 is charged between joined surfaces of convex portion 32 of antenna cap 30 and concave portion 33 of bushing 31 to form no gap between antenna cap 30 and bushing 31. In addition, charging conductive adhesive 22 into the joined surfaces of concave portion 33 and convex portion 32 makes it possible to connect electrically antenna cap 30 and bushing 31 in a more reliable manner.

In the foregoing modification example, antenna cap 30 has convex portion 32, and bushing 31 has concave portion 33. However, the present invention is not limited to this configuration. Antenna cap 30 may have a concave portion, and bushing 31 may have a convex portion. More preferably, however, antenna cap 30 has convex portion 32 in terms of enhancing the mechanical strength of antenna cap 30. The concave portion and the convex portion can be formed in arbitrary shapes as far as they can prevent the formation of a gap by charging a conductive adhesive. For example, their shapes may be intermittently or continuously provided in a vertical or circumferential direction.

According to the configuration of the magnetron in the present exemplary embodiment, it is possible to prevent the antenna cap from falling off the exhaust portion in a more reliable manner. In addition, it is possible to, while the antenna cap is attached to the exhaust portion, prevent occurrence of electric discharge between the antenna cap and the exhaust portion in a more reliable manner. This makes it possible to prevent the high-safety and high-reliability magnetron.

As described above, the magnetron in the present invention includes the main body and the antenna part, the main body having the anode part and the cathode part and the antenna part being connected to the main body and outputs a microwave. The antenna part includes the exhaust portion that is connected to the antenna conductor derived from the anode part and has the output terminal from which the microwave is outputted, the output-side ceramic stem that holds internally the antenna conductor and is firmly fixed to the exhaust portion to insulate electrically the side pipe connected to the anode part of the main body of the magnetron from the exhaust portion, and the antenna cap that is joined to the exhaust portion by the conductive adhesive arranged on the outer periphery of the exhaust portion.

According to this configuration, it is possible to prevent the antenna cap from falling off the exhaust portion. In addition, it is possible to, while the antenna cap is attached to the exhaust portion, prevent occurrence of electric discharge between the antenna cap and the exhaust portion in a more reliable manner.

The magnetron in the present invention may be configured such that the outer peripheral surface of the exhaust portion and the inner peripheral surface of the antenna cap have respective threaded portions to screw and join the antenna cap and the exhaust portion via the conductive adhesive.

The exhaust portion of the magnetron in the present invention includes the exhaust pipe connected to the antenna conductor and serving as the output terminal from which the microwave is outputted and the exhaust pipe holding portion that fixes the exhaust pipe to the output-side ceramic stem. The outer peripheral surface of the exhaust pipe holding portion and the inner peripheral surface of the antenna cap may be joined together via a conductive adhesive.

In the magnetron of the present invention, the antenna cap may be formed of a non-magnetic metallic material.

In the magnetron of the present invention, the exhaust portion may be formed of a non-magnetic metallic material.

In the magnetron of the present invention, the metallic material may have an electric resistivity of $10^{-5}$ Ω·m or less.

In the magnetron of the present invention, the antenna part may output a microwave of 5.0 GHz or more.

INDUSTRIAL APPLICABILITY

The magnetron of the present invention makes it possible to prevent the antenna cap from falling off the exhaust portion even under long-term use.

Accordingly, the magnetron is useful to a microwave generator that is desired to have high safety and reliability.

REFERENCE MARKS IN THE DRAWINGS

1, 100, 101: antenna part
2, 102: anode part
3, 103: cathode part
4, 104: antenna conductor
5, 105: vane
6, 106: filament
7, 107: cathode lead wire

8, 108: terminal-side ceramic stem
9, 109: input terminal
10, 110: antenna cap
10*a*: side surface part
10*aa*, 30*aa*: inner peripheral surface
10*b*: ceiling
10*c*: edge
10*ca*: edge inner peripheral surface
10*d*: lower end surface
11, 111: output-side ceramic stem (insulating ring)
11*a*: upper end surface
12, 112: exhaust pipe
13, 113: chip-off portion
14, 31: exhaust pipe holding portion (bushing)
14*a*, 30*a*: outer peripheral side surface part
14*b*: inner peripheral bottom portion
14*c*: edge
14*ca*: edge outer peripheral surface
14*d*: step
14*e*: inner peripheral end surface
14*f*: lower end surface
15: exhaust portion
16, 17: side pipe
18: anode cylinder
19, 21: threaded portion
20: through hole
22: conductive adhesive
23: cooling fin
24: magnet
25: shield case
26: frame-shaped yoke
30: antenna cap
31*a*: outer peripheral surface
32: convex portion
33: concave portion

The invention claimed is:

1. A magnetron comprising a main body and an antenna part, the main body having an anode part and a cathode part and the antenna part being connected to the main body and outputs a microwave, wherein the antenna part includes:

an exhaust portion that is connected to an antenna conductor derived from the anode part and has an output terminal from which the microwave is outputted;

an output-side ceramic stem that holds internally the antenna conductor and is firmly fixed to the exhaust portion to insulate electrically a side pipe connected to the anode part of the main body of the magnetron from the exhaust portion; and an antenna cap that is joined to the exhaust portion via a conductive adhesive arranged on an outer periphery of the exhaust portion.

2. The magnetron according to claim 1, wherein an outer peripheral surface of the exhaust portion and an inner peripheral surface of the antenna cap include respective threaded portions, and the antenna cap and the exhaust portion are screwed and joined to each other via the conductive adhesive.

3. The magnetron according to claim 1, wherein the exhaust portion includes:

an exhaust pipe connected to the antenna conductor and serving as an output terminal from which the microwave is outputted; and an exhaust pipe holding portion that fixes the exhaust pipe to the output-side ceramic stem, and an outer peripheral surface of the exhaust pipe holding portion and the inner peripheral surface of the antenna cap are joined together via the conductive adhesive.

4. The magnetron according to claim 1, wherein the antenna cap is formed of a non-magnetic metallic material.

5. The magnetron according to claim 1, wherein the exhaust portion is formed of a non-magnetic metallic material.

6. The magnetron according to claim 4, wherein the metallic material has an electric resistivity of $10^{-5}$ Ω·m or less.

7. The magnetron according to claim 1, wherein the antenna part outputs a microwave of 5.0 GHz or more.

8. The magnetron according to claim 2, wherein the exhaust portion includes:

an exhaust pipe connected to the antenna conductor and serving as an output terminal from which the microwave is outputted; and an exhaust pipe holding portion that fixes the exhaust pipe to the output-side ceramic stem, and an outer peripheral surface of the exhaust pipe holding portion and the inner peripheral surface of the antenna cap are joined together via the conductive adhesive.

9. The magnetron according to claim 5, wherein the metallic material has an electric resistivity of $10^{-5}$ Ω·m or less.

* * * * *